US005515143A

United States Patent [19]

Shiotani

[11] Patent Number: 5,515,143

[45] Date of Patent: May 7, 1996

[54] TONER CARTRIDGE WITH SEAL BODY CAPPED UNIT

[75] Inventor: Takashi Shiotani, Toyonaka, Japan

[73] Assignee: Sharp Kabushiki Kaisha, Osaka, Japan

[21] Appl. No.: 442,541

[22] Filed: May 16, 1995

[30] Foreign Application Priority Data

Jun. 17, 1994 [JP] Japan ..... 6-136108

[51] Int. Cl.[6] ..... G03G 15/08

[52] U.S. Cl. ..... 355/260; 141/364

[58] Field of Search ..... 355/215, 260; 222/DIG. 1; 141/364

[56] References Cited

U.S. PATENT DOCUMENTS 4,060,105 11/1977 Feldeisen et al. .
4,937,628 6/1990 Cipolla et al. .
5,307,129 4/1994 Miura et al. .
5,441,177 8/1995 Yanagisawa ..... 222/DIG. 1 X

FOREIGN PATENT DOCUMENTS 60-147768 8/1985 Japan .
5-150644 6/1993 Japan .

*Primary Examiner*—Joan H. Pendegrass
*Assistant Examiner*—Quana Grainger
*Attorney, Agent, or Firm*—Birch, Stewart, Kolasch & Birch

[57] ABSTRACT

A toner cartridge including an engaging protrusion and an engaging concavity on a capped unit formed at one end surface of a container, and on a seal cap capped rotatably on the capped unit, a rotating range limiting opening into which the engaging protrusion fits and a stopping claw disallowing the seal cap to rotate by fitting into the engaging concavity to keep a toner replenishing opening closed. The user can not rotate the seal cap unless he presses down the stopping claw, and thus erroneous toner leakage or scattering can be prevented.

11 Claims, 10 Drawing Sheets

TONER CARTRIDGE WITH SEAL BODY CAPPED UNIT

FIELD OF THE INVENTION

The present invention relates to a toner cartridge used for replenishing a developing device in an image forming apparatus such as a copying machine with toner.

BACKGROUND OF THE INVENTION

In a conventional copying machine, a hopper-shaped toner supplying unit is provided in the main body to supply a developing device with toner, and the toner is sent to be supplied to the developing device by means of an auger or the like. When the toner supplying unit becomes empty, it is removed from the developing device and the toner is replenished from a spare toner bottle. However, replenishing the toner in this way causes the toner to be scattered over and dirties the hands or clothes, thereby making the toner replenishment troublesome.

To solve this problem, Japanese Laid-Open Patent Application No. 5-150644 discloses a mechanism where a toner cartridge attachable to and detachable from the toner supplying unit is used instead of the toner bottle to replenish the toner. With this toner cartridge, a toner replenishing opening is formed on the surface of the cylindrical wall of an airtight cylindrical container filled with the toner, and a shutter plate, which is slidable along the surface of the cylindrical wall in the direction of circumference, is provided on the surface of the cylindrical wall to cover the toner replenishing opening.

On the other hand, at the toner supplying unit in the copying machine main body, an engagement shifting mechanism is provided to a holder unit that supports a portion of the surface of the cylindrical wall of the toner cartridge. The engagement shifting mechanism shifts the toner replenishing opening from the opening position to the closing position and vice versa as the container rotates so as to engage with the shutter plate. This mechanism enables the user to open the toner replenishing opening when the toner cartridge is attached to the toner supplying unit in the copying machine main body, thereby making it unnecessary to open the toner replenishing opening outside of the copying machine in advance. Thus, the toner will not be scattered over, and the manipulation and job efficiency of the toner replenishment is upgraded.

However, with the above-described toner cartridge, the user can open the shutter plate when the toner cartridge is removed from the toner supplying unit. Thus, the toner may be scattered over or undesirable materials may enter through the opening erroneously.

In addition, although the user can open the toner replenishing opening by rotating the container when the toner cartridge is attached to the toner supplying unit, he must confirm visually the position of the container at the relative angle of rotation with respect to the toner replenishing opening when it is open. To be more precise, the position is confirmed when a plane surface provided at the end to serve as a checking mark has become horizontal. For this reason, the user must pay a full attention when rotating the container, and it is often that he re-closes the toner replenishing opening by rotating the container more than necessary. Thus, neither the manipulation nor job efficiency of the toner replenishment is enhanced satisfactory with this toner cartridge.

SUMMARY OF THE INVENTION

It is therefore the object of the present invention to provide a simple toner cartridge that can prevent erroneous toner leakage or scattering while upgrading the manipulation and job efficiency of the toner replenishment.

The above object can be fulfilled by the following toner cartridges of the present invention.

A first toner cartridge includes a cylindrical container for withholding the toner inside, and a toner replenishing opening is formed on a cross-sectional seal body capped unit formed at one end of the container, while a seal body that rotates between the closing position where it seals the toner replenishing opening and the opening position where it opens the same is capped on the outer circumference surface of the seal body capped unit, the first toner cartridge being characterized in that:

an engaging protrusion is formed on the outer circumference surface of the seal body capped unit, while a rotating range limiting opening, into which the engaging protrusion fits, is formed on the seal body to limit the relative moving range in the direction of diameter from the closing position to the opening position;

an engaging concavity unit is formed on the seal body capped unit;

the seal body includes (1) a rotation limiting unit for limiting the rotation of the seal body by engaging with the engaging concavity unit when the seal body is at the closing position, and (2) a press operating unit extending outwards from the outer surface of the seal body; and the rotation limiting unit has a communication with the press operating unit to release the engagement with the engaging concavity unit when an external force is applied to the press operating unit.

According to the above structure, the rotation limiting unit of the seal body engages with the engaging concavity unit of the seal body capped unit when the seal body is at the closing position to seal the toner replenishing opening, thereby making it impossible for the seal body to rotate. Thus, when the first toner cartridge is not attached to the toner supplying unit in the main body such as a copying machine, the user can not rotate the seal body unless he releases the above engagement by pressing down the press operating unit. Therefore, the toner replenishing opening is kept closed unless the user intentionally opens the same, thereby preventing the erroneous toner leakage or scattering.

In addition, since the press operating unit extends outwards from the outer surface of the seal body, a holder unit such that matches with the outer surface of the seal body may be provided in the toner supplying unit in the main body, so that the press operating unit is automatically pressed as the outer surface of the seal body is pressed hard to the internal surface of the holder unit, thereby releasing the engagement between the rotation limiting unit and engaging concavity unit. This eliminates an engagement-release operation, and hence further upgrades the manipulation and job efficiency.

Further, since the rotating range limiting opening that limits both the closing and opening positions is formed on the seal body for the engaging protrusion on the seal body capped unit, the container will not be rotated more than necessary when attaching the first toner cartridge to the toner supplying unit in the main body. As a result, the user can open the toner replenishing opening without fail, which also enhances the manipulation efficiency.

A second toner cartridge of the present invention, in addition to the structure of the first toner cartridge, is characterized in that:

it includes a plate member, which extends through an opening formed on the wall surface of the seal body and is tilted with respect to the wall surface;

the plate member has a communication with the wall surface of the seal body by means of a central axis unit having torsional elasticity at the center thereof, so that it rotates to a position where it becomes parallel to the wall surface from the tilting position; and the inward part of the plate member from the wall surface of the seal body is the rotation limiting unit and the outward part of the same is the press operating unit.

According to the above structure, a simple structure that tilts a single plate member with respect to the wall surface of the seal body by means of the central axis unit having torsional elasticity realizes the functions of both the rotation limiting unit and press operating unit. As a result, the entire structure is simplified.

A third toner cartridge of the present invention, in addition to the structure of the first or second toner cartridges, is characterized in that the outer surface of the seal body capped on the seal body capped unit of a cross-sectional shape is tapered to make the diameter of the top end smaller than that of the other end.

According to the above structure, since the outer surface of the seal body is tapered, providing a holder unit having a tapered concavity unit that matches with the outer surface of the seal body in the toner supplying unit in the main body prevents the hook of the press operating unit by the end surface at the opening of the holder unit when inserting the sealing body into the holder unit. Thus, even the press operating unit extends outwards from the outer surface of the seal body, the seal body can be easily inserted into and removed from the holder unit.

For a fuller understanding of the nature and advantages of the invention, reference should be made to the ensuing detailed description taken in conjunction with the accompanying drawings.

BRIEF DESCRIPTION OF THE DRAWINGS

FIG. 6(*a*) is a cross sectional view at an engaging protrusion formed on the capped unit; FIG. 6(*b*) is a cross sectional view at a stopping claw formed in the seal cap.

FIG. 10(*a*) is a cross sectional view at the engaging protrusion formed on the capped unit; FIG. 10(*b*) is a cross sectional view at the stopping claw formed in the seal cap.

DESCRIPTION OF THE EMBODIMENT

An embodiment of the present invention will be explained in the following while referring to FIGS. 1 through 15.

Figure 14:
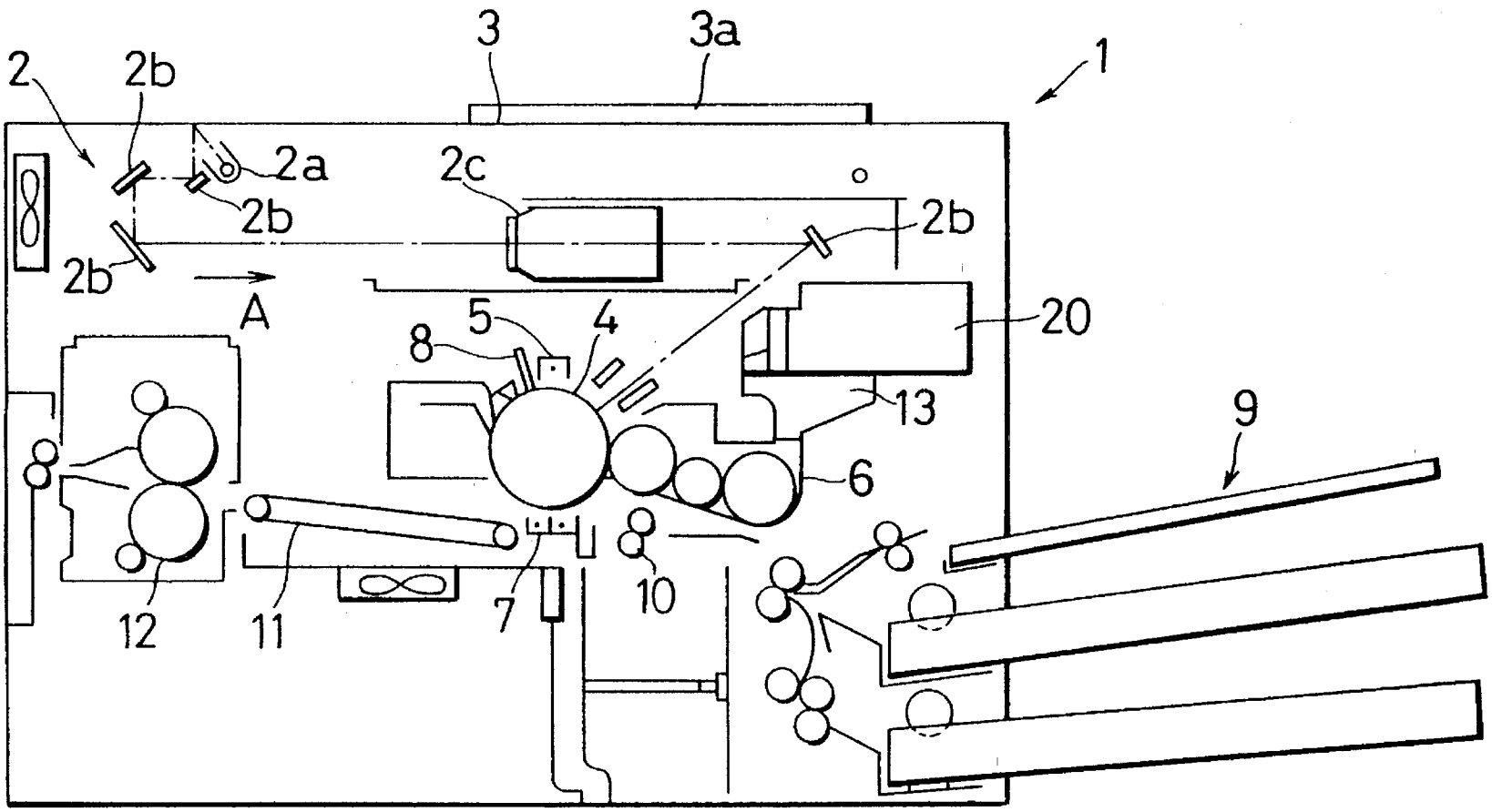
FIG. 14 is a schematic cross sectional view depicting the structure of the copying machine when the toner cartridge is inserted.

First, the entire structure and operation of a copying machine, or an image forming apparatus, of the present invention will be explained while referring to FIG. 14. As shown in the drawing, an optical series 2 is provided in the upper part of a copying machine main body 1. The optical series 2, which is placed on an unillustrated mirror base, has a copy lamp 2*a* such as a tungsten lamp serving as a light source lamp, a plurality of plane mirrors 2*b*, and a zooming lens 2*c*.

A document table 3, which is covered by a document cover 3*a*, is formed at the upper part of the copying machine main body 1, and light emanated from the copy lamp 2*a* is irradiated to an unillustrated document placed on the document table 3. The light reflected by the document is sequentially reflected by each of the plane mirrors 2*b* as is indicated by the alternate long and short dash line in the drawing, and led to the surface of a cylindrical photosensitive body 4 provided around the center of the copying machine main body 1 to expose the same. Accordingly, a definitive image is formed on the surface of the photosensitive body 4, forming an electrostatic latent image corresponding to the image on the document on the surface of the photosensitive body 4.

The photosensitive body 4 is rotatably supported in the copying machine main body 1, and around which a charging device 5 for applying a given voltage to the surface of the photosensitive body 4, a developing unit 6 for developing the electrostatic latent image into a visible toner image with the toner, a transferring device 7 for transferring the toner image onto a sheet of paper, and an eraser 8 for removing the charges remaining on the surface of the photosensitive body 4 are provided in the sequence of explanation.

When making a copy of the document on the document table 3 using the above-structured copying machine, the surface of the photosensitive body 4 is charged at a given electric potential by the charging device 5 first, then the unillustrated mirror base, on which the optical series 2 is placed, is moved in the direction indicated by the arrow A in the drawing. Under these conditions, the light emanated from the copy lamp 2*a* on the mirror base is irradiated sequentially across the document, that is to say, the light scans the document. The reflected light from the document is led to the surface of the photosensitive body 4 by way of the plurality of plane mirrors 2*b* and zooming lens 2*c* of the optical series 2 to expose the same, thereby forming the electrostatic latent image thereon.

Note that an unillustrated automatic document feeder may be additionally provided on the document table 3. In this case, a plurality of documents loaded in the automatic document feeder are sequentially fed to the document table 3 per sheet, and the electrostatic latent images corresponding to the documents are sequentially formed on the photosensitive body 4 by repeating the electrostatic latent image forming operation in the same manner as above for each document.

On the other hand, a feeding unit 9 having a plurality of feeding cassettes each containing different size of sheets is provided on the side of the copying machine main body 1. An unillustrated sheet is fed towards the photosensitive body 4 by an unillustrated feeding clutch from the feeding cassette selected by the user. The sheet thus fed is halted by a pair of resist rollers 10 when it is necessary to adjust the timing for the toner image to be formed on the surface of the photosensitive body 4, then fed into between the photosensitive body 4 and transferring device 7.

While the sheet is sandwiched by the photosensitive body 4 and transferring device 7, a given voltage is applied to the transferring device 7. Accordingly, the transferring device 7 and hence the sheet are charged, and the toner image formed on the surface of the photosensitive body 4 is transferred onto the sheet. Then, the sheet is removed from the photosensitive body 4, and forwarded to a fuser 12 by a transferring unit 11. By being sent through pairs of heating rollers and pressure-applying rollers in the fuser 12, the toner image is fixed onto the sheet.

Next, the structure of the above-structured copying machine main body 1 for replenishing the toner from the external will be explained.

A hopper-shaped toner supplying unit 13 withholding the toner inside is further provided above the developing unit 6, and a toner cartridge 20 is attached to the upper surface of the toner supplying unit 13.

Figure 15:
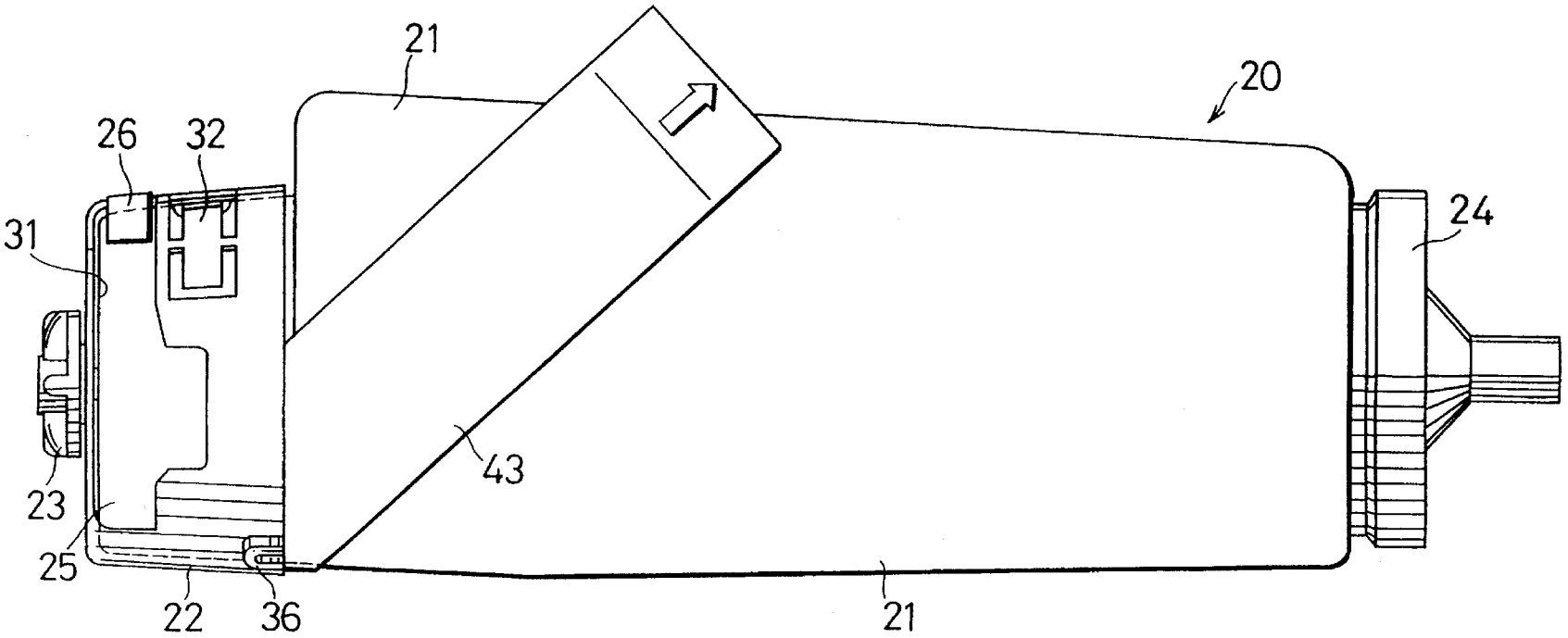
FIG. 15 is a front view showing the entire structure of the toner cartridge.

The toner cartridge 20, as shown in FIG. 15, has a cylindrical airtight container 21 withholding the toner inside and capped with a seal cap (seal body) 22 at one end thereof (the left end in the drawing, which is referred to as the top end side hereinafter), and a substantially circular coupling plate 23 of a small diameter placed at the center of the top end surface of the seal cap 22. The seal cap 22 and container 21 are made of engineering plastic materials, for example, ABS resin and polyethylene, respectively.

Note that when manufacturing the toner cartridge 20, the container 21 is filled with a given amount of toner through an unillustrated filling opening formed at the right end surface thereof, and a closing lid 24 made of a plastic material, which is irremovable once applied, is adhered to the right end side (which is referred to as the bottom end side) of the container 21 to airtight the filling opening.

Figure 1:
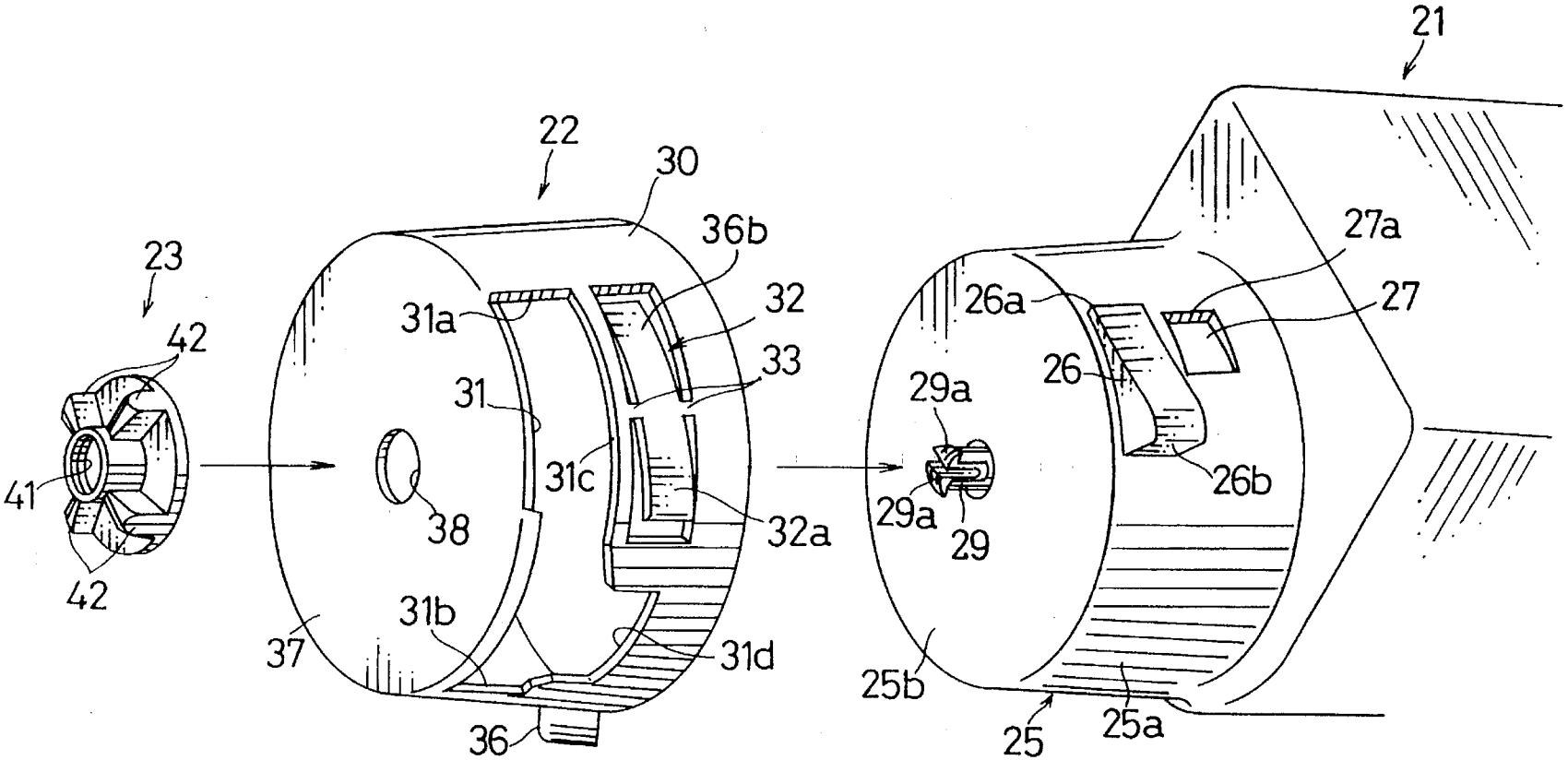
FIG. 1 is an exploded top perspective view showing the major structure of a toner cartridge in accordance with an embodiment of the present invention.

On the top end side of the container 21, as shown in FIG. 1, a substantially cylindrical capped unit (a seal body capped unit) 25 is swell-formed. The outer circumference surface (referred to as the outer circumference surface **25*a* hereinafter) of the capped unit 25 is tapered a little, so that the diameter on the top end side becomes smaller than that of the other side. Also, an engaging protrusion 26 extending outwards in the direction of diameter is formed on the outer circumference surface 25*a*** at the upper part thereof in the drawing.

Further, an engaging concavity unit 27 having a concavity extending inwards in the direction of diameter is formed behind the engaging protrusion 26.

The engaging protrusion 26 is a protrusion formed on the outer circumference surface **25*a* to extend outwards in the direction of diameter in a range at, for example, 40 degrees with respect to the direction of circumference. By making the both ends thereof in the direction of circumference into planes perpendicular to the outer circumference surface 25*a*, the end surfaces at the left and right are formed as a first stopping surface 26*a* and a second stopping surface 26*b***, respectively.

On the other hand, the engaging concavity unit 27 is formed by flattening a portion of the outer circumference surface **25*a*, and a third stopping surface 27*a*, which is perpendicular to the outer circumference surface 25*a*, is formed on the left end side of the engaging concavity unit 27 in the direction of circumference. The third stopping surface 27*a* is located in substantially the same position as the first stopping surface 26*a*** in the direction of circumference.

Figure 2:
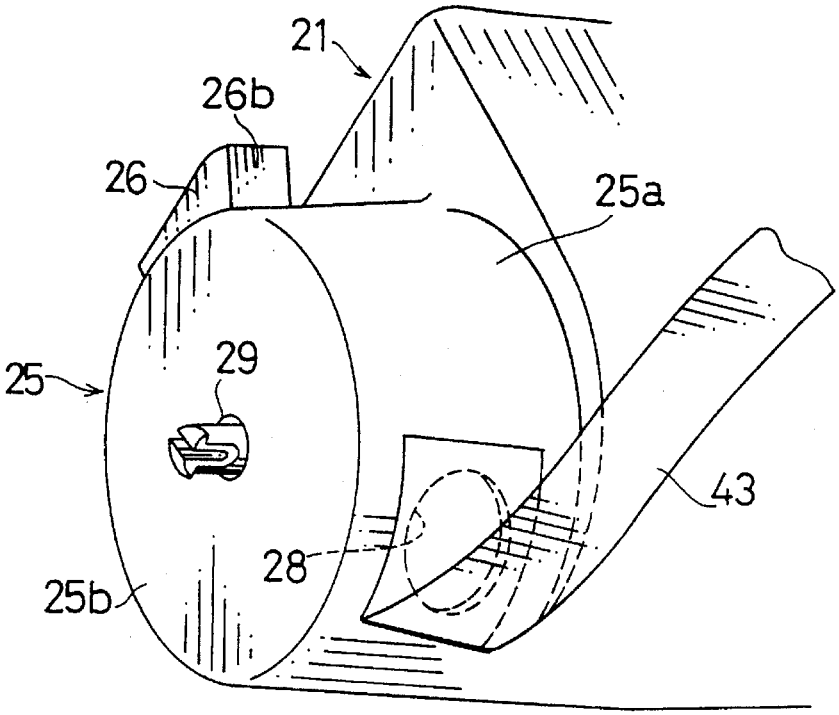
FIG. 2 is a bottom perspective view showing a capped unit of a container of the toner cartridge.

Further, as shown in FIG. 2, at the lower part of the outer circumference surface **25*a*, a circular toner replenishing opening 28 is formed through, and an axis unit 29 extends through the center of an end surface 25*b* of the top end side of the capped unit 25. The other end of the axis unit 29 extends as far as the bottom end side through the container 21. On the circumference surface of the axis unit 29, an unillustrated toner transferring wing is attached, which rotates on the container 21 as the axis unit 29 rotates. Accordingly, a force developed towards the capped unit 25 on the top end side from backwards is applied to the toner in the container 21**.

The seal cap 22, as shown in FIG. 1, is of a cup shape whose bottom end can be opened, and a cylindrical circumference wall surface 30 is tapered to match with the outer circumference surface of the capped unit 25. A rotating range limiting opening 31 is formed on the top end side of the circumference wall surface 30. The rotating range limiting opening 31 is, for example, as long as the range of 135 degrees in the direction of circumference and wider than the thickness of the engaging protrusion 26 on the container 21 in the direction of axis. The edges of both ends in the direction of circumference are substantially parallel with each other in the direction of axis, and the upper edge forms a first limiting side **31*a* while the lower edge forms a second limiting side 31*b***.

Note that a side **31*c* formed on the bottom end side of the rotating range limiting opening 31 is cut out backwards to form an assembling cutout opening 31*d* on the side of the second limiting side 31*b* in such a manner that it communicates with the rotating range limiting opening 31**.

On the other hand, a stopping claw 32 made of a strip plate member extending in the direction of circumference is provided on the side of the first limiting side **31*a* of the rotating range limiting opening 31 by forming a rectangular through groove on the circumference wall surface 30. The stopping claw 32 is an arch piece having the substantially same curvature as the circumference wall surface 30, and communicates therewith by means of two central axis units 33** at the center of the top and bottom ends in the direction of circumference.

The stopping claw 32 is tilted with respect to the circumference wall surface 30. That is to say, the lower part from the two central axis units 33 in the drawing (which is referred to as the press operating unit **32*a* hereinafter) is formed to extend outwards from the circumference wall surface 30 in the direction of diameter, while the upper part from the two central axis units 33 (which is referred to as the rotation limiting unit 32*b*) is formed to extend inwards from the circumference wall surface 30 in the direction of diameter. The end surface of the rotation limiting unit 32***b* in the direction of circumference is located behind the first limiting side 31*a* of the rotating range limiting opening 31.

To be more precise, for example, when an external force is applied to the press operating unit 32*a* towards the center of the diameter, the entire stopping claw 32 rotates around the two central axis units 33 to a position where it becomes parallel to the cylindrical surface of the circumference wall surface 30 from the tilting position. Such a rotation occurs repeatedly due to torsional elasticity of the two central axis units 33.

Figure 3:
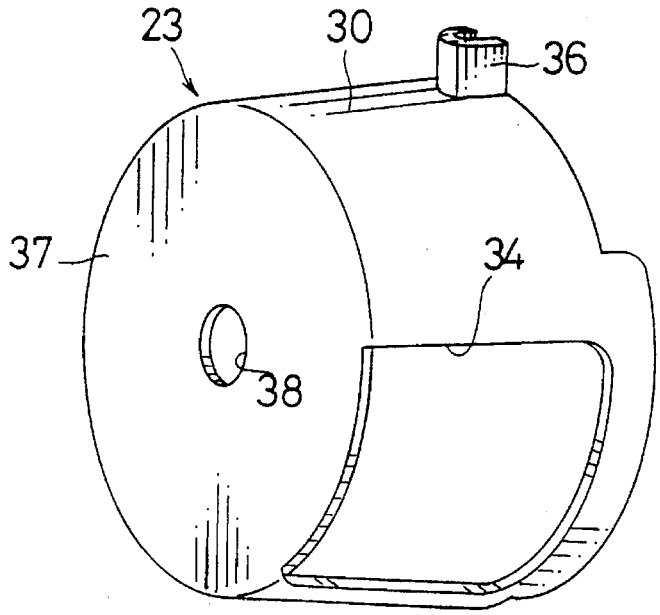
FIG. 3 is a bottom perspective view of a seal cap of the toner cartridge.

Further, a rectangular opening 34 as shown in FIG. 3 is formed on a part of the circumference wall surface 30 opposing the rotating range limiting opening 31 and stopping claw 32. The rectangular opening 34 is formed by cutting out the circumference wall surface 30 in square, for example, in the range of 75 degrees in the direction of circumference and almost entirely in the direction of axis. Although it is not illustrated, a sheet of a buffering seal material made of a felt or the like is adhered to the internal surface of the rectangular opening 34 at the both ends of the circumference wall surface 30 in the direction of circumference.

Further, an attachment position determining protrusion 36, which extends outwards in the direction of diameter, is formed on the bottom end side of the outer surface of the circumference wall surface 30, while a circular through hole 38 is formed at the center of an end surface 37 which covers the top end side.

As shown in FIG. 1, a hole 41 is formed at the center of the coupling plate 23, into which the axis unit 29 of the container 21 is inserted, and four protrusions 42 are formed to extend radially on the front surface side, thereby forming a so-called crown gear.

Next, the assembling sequence of the toner cartridge 20 composed of the container 21, seal cap 22, and coupling plate 23 will be explained.

First, as shown in FIG. 2, before filling the toner in the container 21, a tape of a seal sheet 43 is adhered to the outer circumference surface 25*a* at one end to seal the toner replenishing opening 28. The tape is adhered with a hot melt, adhesive agent, adhesive double coated tape, etc. to be removed later. Then, as has been explained, a given amount of toner is filled through the filling opening made at the right end surface of the container 21, and the closing lid 24 is adhered to airtight the same.

Figure 4:
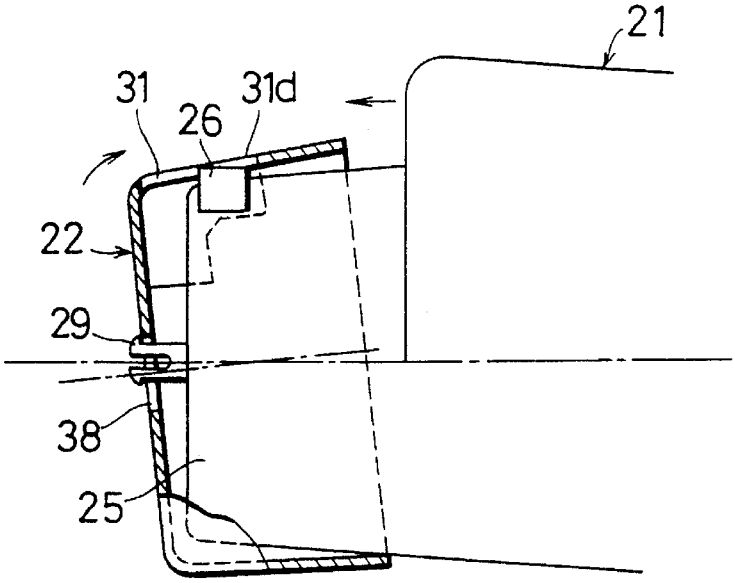
FIG. 4 is a partial cutout cross sectional view of the capped unit when capped with the seal cap.

Next, the capped unit 25 of the container 21 is capped with the seal cap 22. At this point, as shown in FIG. 4, the locational relation between the capped unit 25 and seal cap 22 in the direction of circumference is determined in such a manner that the engaging protrusion 26 opposes the assembling cutout opening 31*d* of the seal cap 22 in the direction of axis. Then, the capped unit 25 of the container 21 is gradually inserted into the seal cap 22 as the seal cap 22 is adequately tilted with respect to the center of the axis of the container 21. According to the above manipulation, the axis unit 29 is inserted through the through hole 38 without deforming the seal cap 22, while the engaging protrusion 26 fits into the assembling cutout opening 31*d*. The shape of the assembling cutout opening 31*d* and the diameter of the through hole 38 are determined in advance to realize the above state.

By further inserting the capped unit 25 of the container 21 into the seal cap 22 while matching the axes of the container 21 and seal cap 22, the seal cap 22 comes to have a close contact with the outer circumference surface of the capped unit 25 of the container 21, and the engaging protrusion 26 moves towards the rotating range limiting opening 31 from the assembling cutout opening 31*d*.

Figure 5:
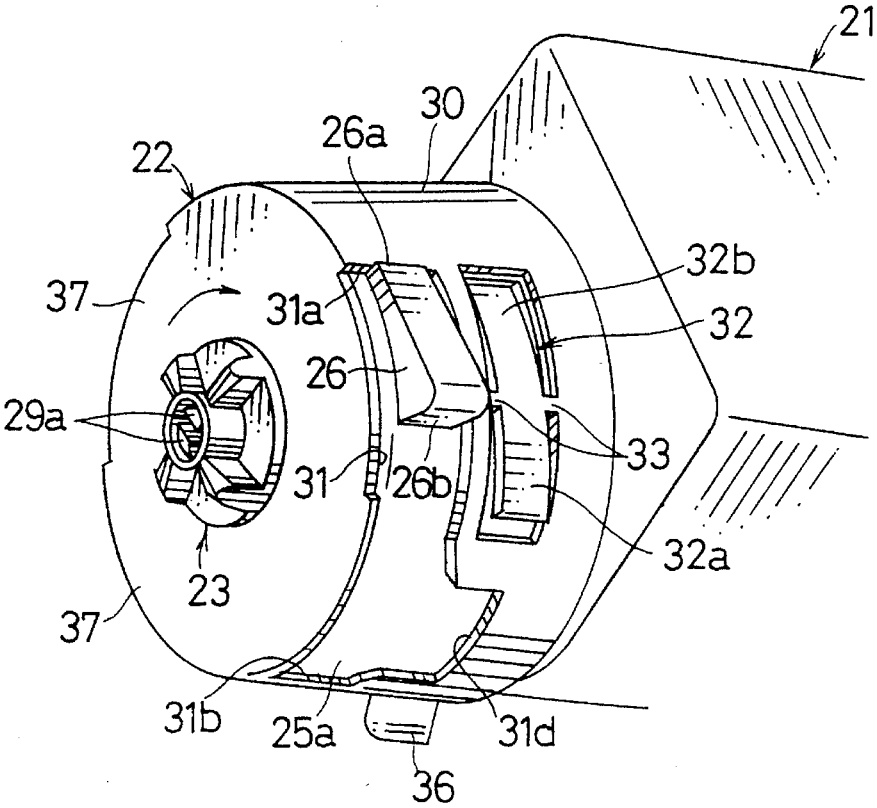
FIG. 5 is a top perspective view of the toner cartridge when assembled.

Next, as shown in FIG. 5, the coupling plate 23 is placed through the axis unit 29 extending from the end surface 37 of the seal cap 22 to engage with the same. As a result, the coupling plate 23 becomes irremovable towards the top end side because of two stopping protrusions 29*a* formed at the edge of the axis unit 29. The coupling plate 23 makes the seal cap 22 not only irremovable towards the top end side but also rotatable around the outer circumference surface 25*a*.

Figure 6:
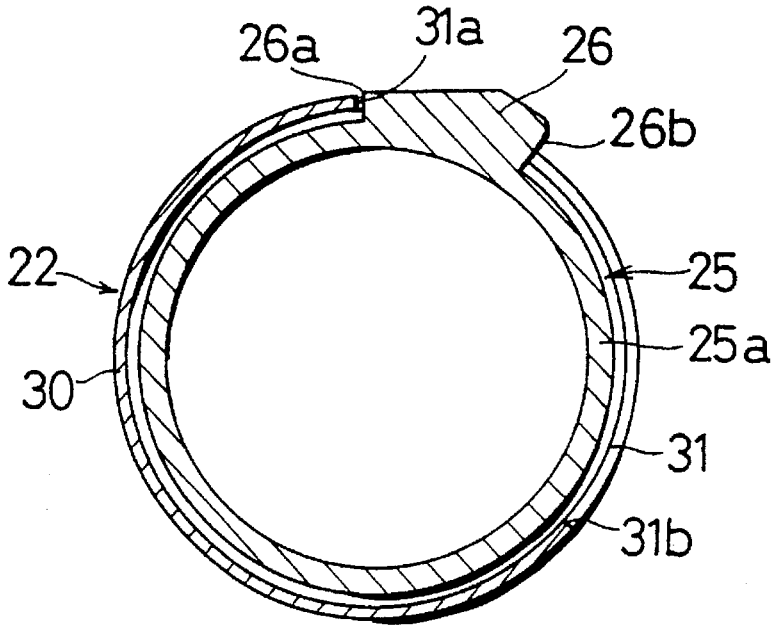
FIGS. 6(*a*) and 6(*b*) are views showing the assembled state in FIG. 5.
Figure 6:
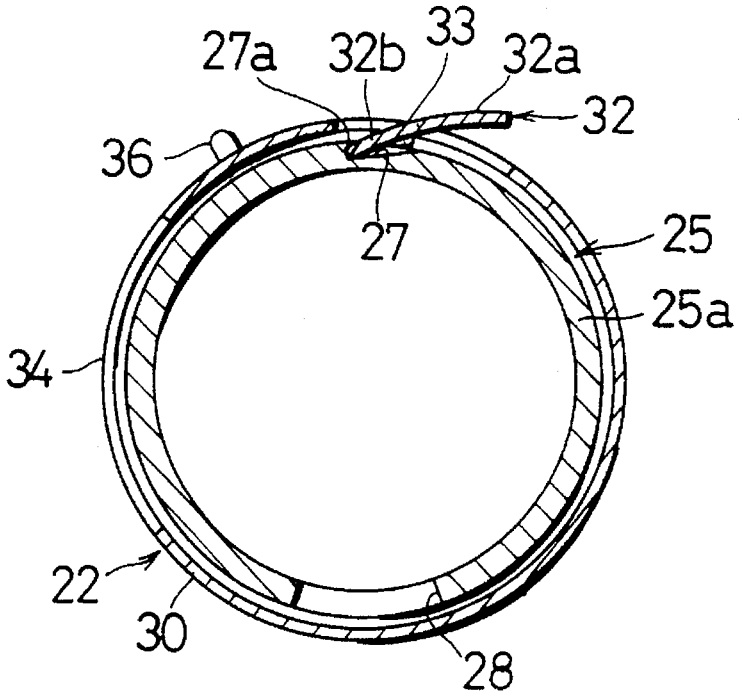

Assembled in this way, the stopping protrusion 26 moves in the rotating range limiting opening 31 in the direction of circumference as the seal cap 22 is rotated clockwise. As shown in the drawing, when the seal cap 22 is rotated until the first stopping surface 26*a* of the stopping protrusion 26 has a contact with the first limiting side 31*a* of the rotating range limiting opening 31, the end surface side of the rotation limiting unit 32*b* of the stopping claw 32 in the direction of circumference fits into the engaging concavity unit 27. That is to say, as shown in FIG. 6(*a*), the contact of the first stopping surface 26*a* of the engaging protrusion 26 to the first limiting side 31*a* disallows the seal cap 22 to rotate clockwise. Also, as shown in FIG. 6(*b*), placing the end surface of the rotation limiting unit 32*b* of the stopping claw 32 to oppose the third stopping surface 27*a* of the engaging concavity unit 27 disallows the seal cap 22 to rotate counterclockwise. Note that the torsional elasticity of the central axis units 33 supporting the stopping claw 32 serves as a counterclockwise energizing force around the central axis units 33. This means that unless an external force is applied to the stopping claw 32, the above state is maintained.

As shown in FIGS. 6(*a*) and 6(*b*), the toner replenishing opening 28 formed on the capped unit 25 is covered by the circumference wall surface 30 of the seal cap 22 at this point. The seal sheet 43, which is previously explained and not illustrated herein, is sandwiched between the seal cap 22 and capped unit 25 at one end to seal the toner replenishing opening 28 at this point; however, note that when the toner cartridge 20 is assembled, the other end comes out backwards from the bottom end of the seal cap 22 by being rolled up in the seal cap 22 as shown in FIG. 15.

With the toner cartridge 20 thus assembled, the toner replenishing opening 28 is tightly sealed with both the seal sheet 43 and the seal cap 22. For this reason, the toner filled in the toner cartridge 20 is not susceptible to the external environment and the vibration during the transportation.

Next, the sequence of attaching the toner cartridge 20 to the toner supplying unit 13 of the copying machine main body 1 will be explained.

To begin with, the structure of a holder unit 51 provided in the toner supplying unit 13 will be explained while referring to FIG. 7. The holder unit 51 has a concavity unit that matches with the outer shape of the seal cap 22, and a toner outlet 52 below the concavity unit to let the toner flow down into the toner supplying unit 13. Also, a seal cushion 53 made of a sheet of an elastic material is adhered around the toner outlet 52 in a matching shape with the rectangular opening 34 of the seal cap 22.

On the other hand, a concave stopping cutout 54 is formed on the end surface of the holder unit 51 on the opening side, into which the attachment position determining protrusion 36 of the seal cap 22 fits. Further, although it is not illustrated, an engaging groove into which the engaging protrusion 26 of the container 21 fits, is formed on the internal surface of the holder unit 51. The engaging groove extends forward in the direction of axis from the opening end surface of the holder unit 51 along the trace of the movement of the engaging protrusion 26 made when the toner cartridge 20 is attached, and changes the extending direction to the direction of circumference on the front side, which will be explained below.

When inserting the toner cartridge 20 into the holder unit 51, the seal sheet 43 shown in FIG. 15 is pulled out in the direction indicated by an arrow shown at the end first, and the other end sealing the toner replenishing opening 28 is also removed accordingly. Note that, even there is a space between the outer circumference surface of the capped unit 25 and the circumference wall surface 30 of the seal cap 22, the space is filled with the previously-mentioned buffering seal material adhered to the circumference wall surface 30, thereby preventing the toner leakage through the toner replenishing opening 28.

Figure 7:
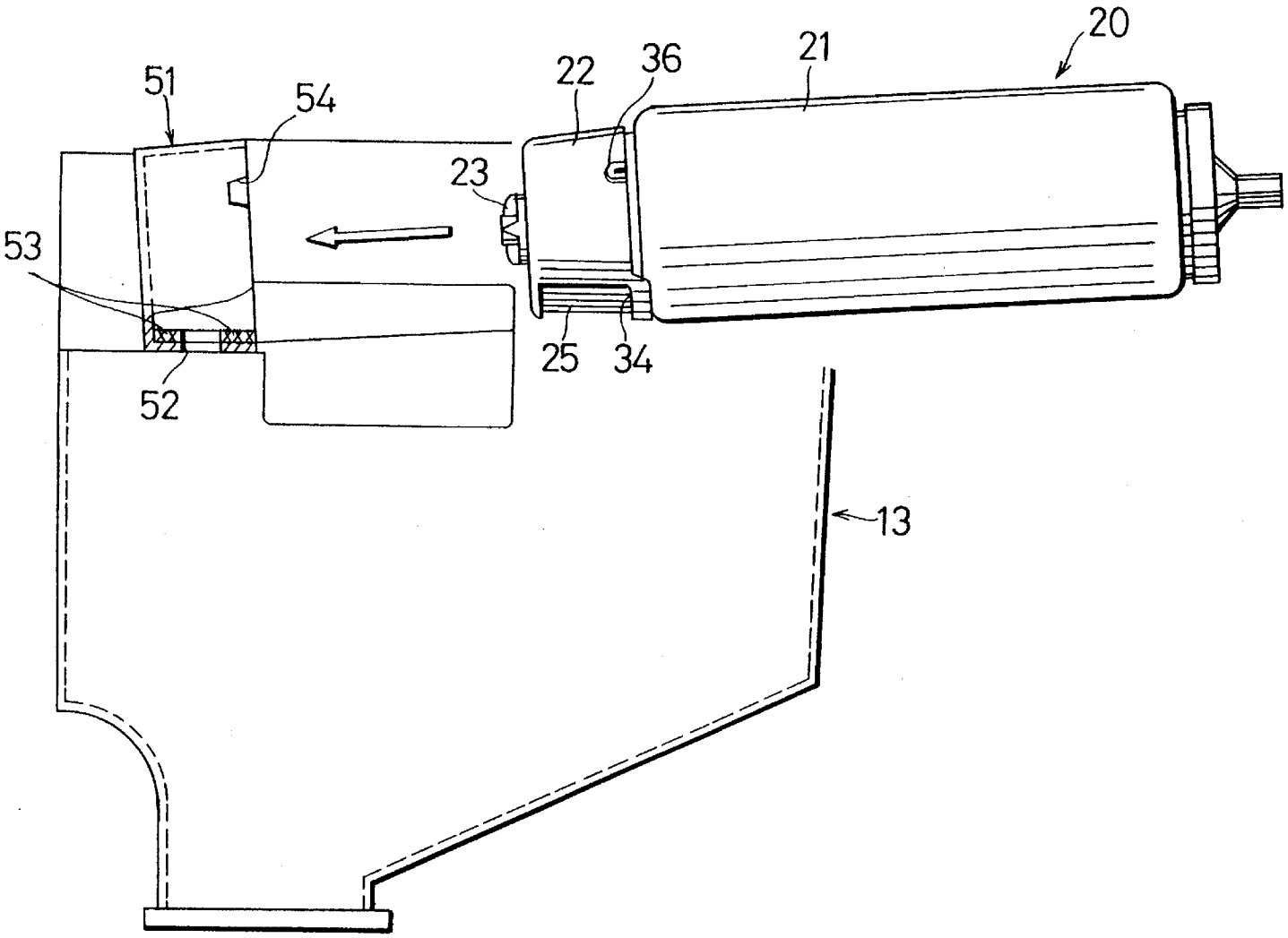
FIG. 7 is a view explaining the manipulation of attaching the toner cartridge to the toner supplying unit of a copying machine main body.

When the seal sheet 43 is removed, the toner cartridge 20 is moved in the direction of axis to the toner supplying unit 13 in the copying machine main body 1 as shown in FIG. 7 to insert the seal cap 22 into the holder unit 51. In so doing, the position of the angle of rotation in the direction of circumference of the toner cartridge 20 is kept in such a manner that the rectangular opening 34 of the seal cap 22 faces downwards. Thus, the engaging protrusion 26 extending outwards from the outer surface of the seal cap 22 moves in the engaging groove formed on the internal surface of the holder unit 51 in the direction of axis. When the seal cap 22 is inserted until the entire outer circumference surface thereof has a close contact with the internal surface of the holder unit 51, the attachment position determining protrusion 36 of the seal cap 22 fits in the stopping cutout 54 of the holder unit 51, thereby making it impossible for the seal cap 22 to rotate in the holder unit 51.

When the outer circumference surface of the seal cap 22 has a close contact with the internal surface of the holder unit 51 as above, the press operating unit 32*a* of the stopping claw 32, positioned outwards from the outer circumference surface of the seal cap 22 in the direction of diameter, is pressed down inwards in the direction of diameter by a pressing force developed from the internal surface of the holder unit 51. Consequently, the entire stopping claw 32 rotates around the two central axis units 33, and moves the rotation limiting unit 32*b* outwards in the direction of diameter, thereby releasing the same from the engaging concavity unit 27. Accordingly, the engagement between the rotation limiting unit 32*b* and engaging concavity unit 27 is released, which enables the user to rotate the container 21 in the direction the engagement is released.

Figure 8:
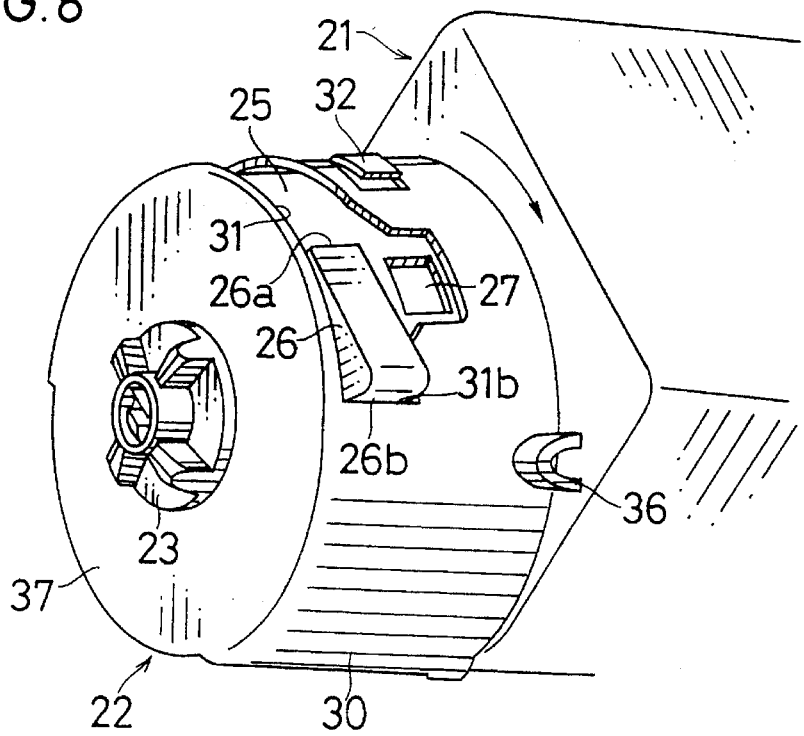
FIG. 8 is a top perspective view when the container is rotated from the assembled state shown in FIG. 5.
Figure 9:
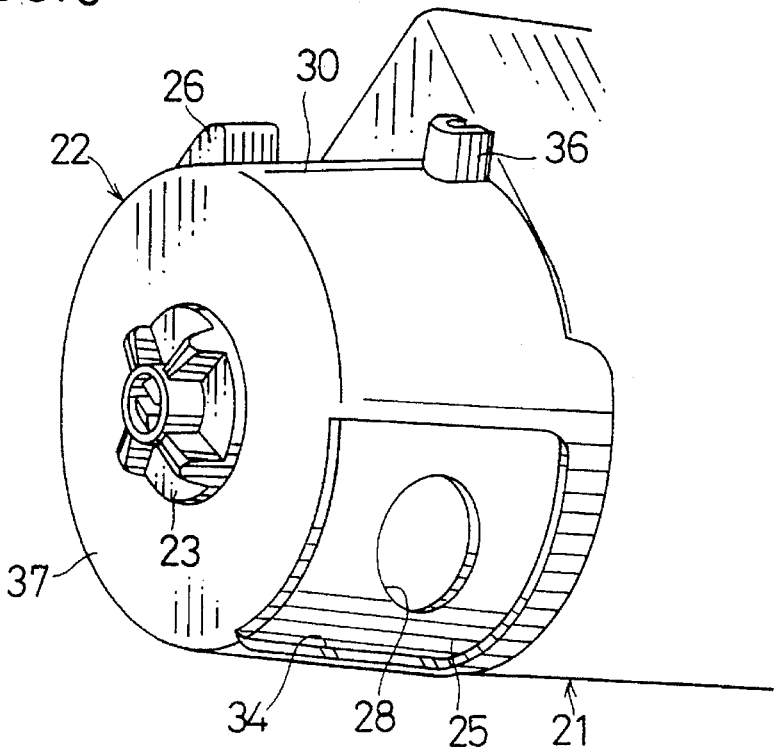
FIG. 9 is a bottom perspective view of the assembled state in FIG. 8.

Subsequently, the container 21 is rotated in the above direction. As shown in FIG. 8, the engaging protrusion 26 moves in the direction of circumference in the rotating range limiting opening 31 according to the rotating manipulation. The rotation stops when the second stopping surface 26*b* has a contact with the second limiting side 31*b* of the rotating range limiting opening 31. The rotating manipulation ends when the container 21 is rotated up to the above position, and accordingly, as is shown in FIG. 9, the toner replenishing opening 28 of the capped unit 25 is positioned in the rectangular opening 34 of the seal cap 22, meaning that the toner replenishing opening 28 is opened.

Further, the relation between the toner cartridge 20 and holder unit 51 after the rotating manipulation will be explained while referring to FIGS. 10(*a*) and 10(*b*). First, as shown in FIG. 10(*a*), the outward end side of the engaging protrusion 26, which moves in the rotating range limiting opening 31 in the direction of circumference, moves in the engaging groove formed on the internal surface of the holder unit 51 as far as the opening position where the toner replenishing opening 28 is opened.

Figure 10:
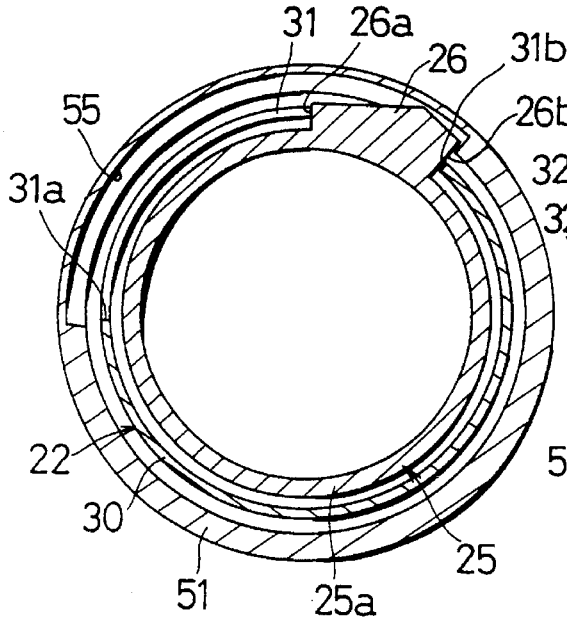
FIGS. 10(*a*) and 10(*b*) show the states when the container is rotated when the toner cartridge is attached to a holder unit of the toner supplying unit.
Figure 10:
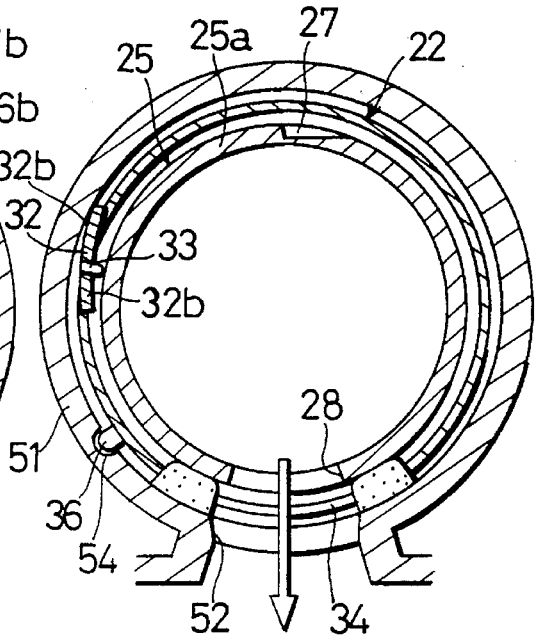
Figure 11:
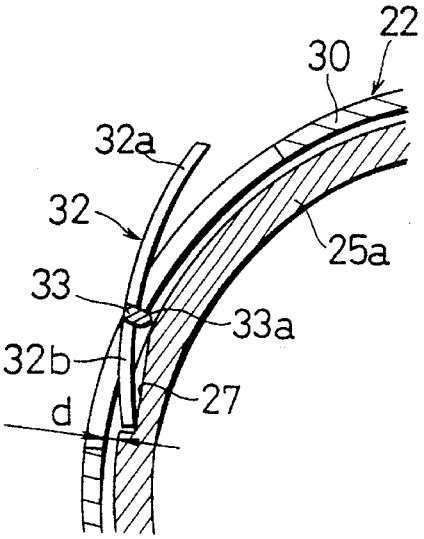
FIG. 11 is a partially enlarged cross sectional view showing the state when the stopping claw engages with the capped unit.

On the other hand, as shown in FIG. 10(*b*), the rotation limiting unit 32*b* of the stopping claw 32 has a contact with the internal surface of the holder unit 51 and is pressed inwards, by which the rotation limiting unit 32*b* is spaced apart from the outer circumference surface 25*a*.

Also, as shown in the drawing, the toner replenishing opening 28 of the capped unit 25 is positioned in the rectangular opening 34 of the seal cap 22, and this position maps on the toner outlet 52 formed in the holder unit 51, thereby making a communication between the toner replenishing opening 28 and toner supplying unit 13. Note that, as previously explained, the drawing shows that the seal cap 22 is maintained not to rotate by fitting the attachment position determining protrusion 36 of the seal cap 22 into the stopping cutout 54 of the holder unit 51.

Given these conditions, the crown gear of the front end of the coupling plate 23 at the top end of the toner cartridge 20 engages with an unillustrated driving gear provided in the toner supplying unit 13. Thus, when the amount of toner in the toner supplying unit 13 decreases, the driving gear is driven, which rotates the axis unit 29 engaging with the coupling plate 23 and hence the toner transferring wing attached to the axis unit 29 within the container 21. Consequently, the toner in the container 21 is sent forward, being supplied to the toner supplying unit 13 through the toner replenishing opening 28.

Note that each of the axis units 33 that make the communication between the stopping claw 32 and the circumference wall surface 30 of the seal cap 22 is of a thickness such that makes the same extend inwards from the internal surface of the circumference wall surface 30 in the direction of diameter, and a protrusion (which is referred to as a rib hereinafter) 33*a* thus made on the internal surface thereof is of a thickness such that secures a space d which is as wide as the rib 33*a* between the outer circumference surface 25*a* and the internal surface of the seal cap 22. According to this structure, the press operating unit 32*a* is pressed by the internal surface of the holder unit 51, which insures the release of the rotation limiting unit 32*b* from the engaging concavity unit 27 when the entire stopping claw 32 moves to a position where it becomes substantially parallel to the circumference wall surface 30 of the seal cap 22.

Figure 12:
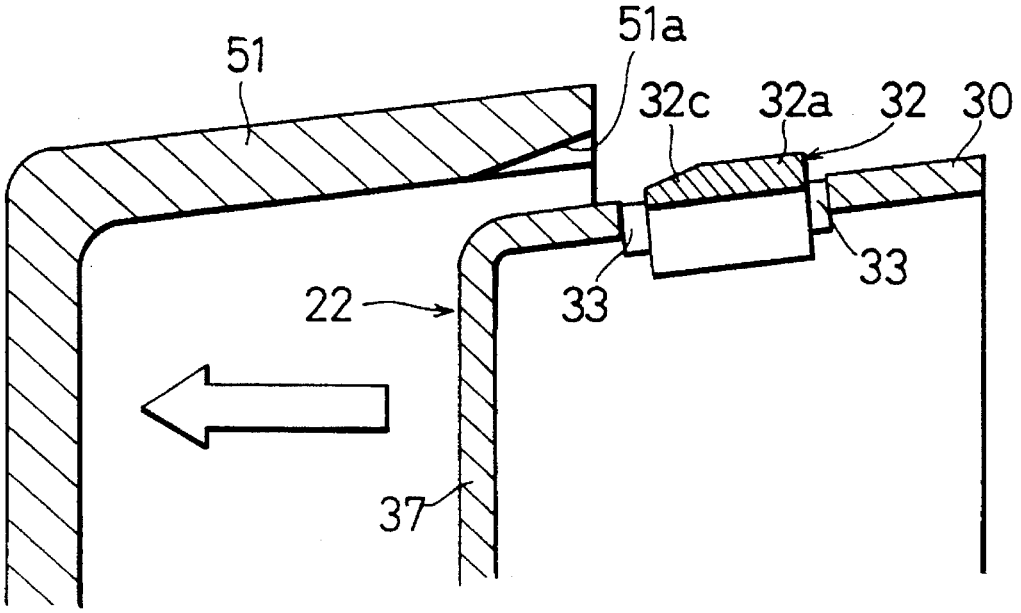
FIG. 12 is an enlarged cross sectional view explaining the state when the seal cap is inserted into the holder unit.

Further, the stopping claw 32, as shown in FIG. 12, has a chamfered unit 32*c*, which is formed by diagonally cutting out the corner of the top end side of the press operating unit 32*a*. Also, a slope surface 51*a* is formed at the corner of the inner circumference of the end surface of the holder unit 51 on the opening end side to match with the chamfered unit 32*c*. The chamfered unit 32*c* and slope surface 51*a* are formed besides tapering the circumference wall surface 30 of the seal cap 22 and the internal surface of the holder unit 51. Thus, when the seal cap 22 moves in the direction of axis, the hook of the press operating unit 32*a* by the end surface of the holder unit 51 is prevented, enabling the press operating unit 32*a* to slide smoothly along the internal surface of the holder unit 51 as it moves in the direction of axis when inserting the seal cap 22 into the holder unit 51.

Figure 13:
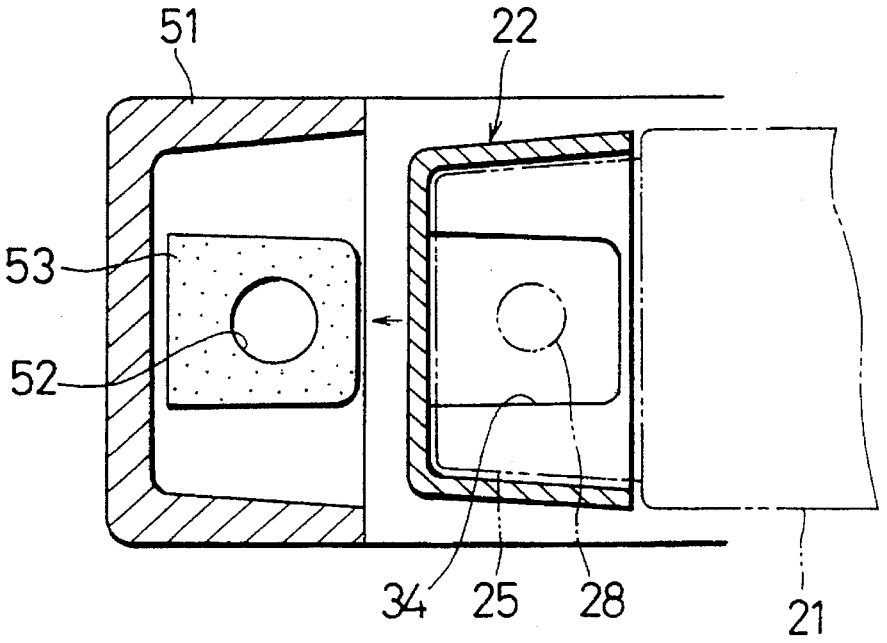
FIG. 13 is a top cross sectional view explaining the state when the toner cartridge is attached to the holder unit.

On the other hand, FIG. 13 is a top schematic cross sectional view of the toner cartridge 20 when it is inserted into the holder unit 51. As is shown in the drawing, since the circumference wall surface 30 of the seal cap 22 and the internal surface of the holder unit 51 are tapered, these two components can be easily attached and detached. Also, as previously mentioned, the seal cushion 53 is adhered around the toner outlet 52 in a shape that fits into the rectangular opening 34, and the seal cushion 53 fills the space between the internal surface of the holder unit 51 and the outer circumference surface of the capped unit 25 around the toner replenishing opening 28. Thus, the toner flowing therein is supplied to the toner supplying unit 13 through the toner outlet 52 of the holder unit 51 without fail, preventing the toner leakage or scattering to the outside of the toner supplying unit 13.

When the toner in the toner cartridge 20 is consumed, the toner cartridge 20 is replaced with a new one. The consumed toner cartridge 20 is removed in a manner reversed to that of the attaching manipulation. To be more precise, when the toner replenishing opening 28 is in the rectangular opening 34, the engaging protrusion 26 extending from the rotating range limiting opening 31 of the seal cap 22 engages with the engaging groove 55 formed in the holder unit 51. Under these conditions, the engaging protrusion 26 stops in the engaging groove 55 extending in the direction of axis, meaning that it can not be pulled out in the same direction.

Therefore, it is necessary to rotate the container 21 in a direction opposite to the direction of the attaching manipulation. By so doing, the engaging protrusions 26 moves in the opposite direction in the engaging groove 55 and rotating range limiting opening 31. As the container 21 is rotated until the first stopping surface **26*a* of the engaging protrusion 26 has a contact with the first limiting side 31*a* of the rotating range limiting opening 31 of the seal cap 22, the engaging protrusion 26 moves in the engaging groove 55 to a point extending in the direction of axis and communicating with the end surface of the opening of the holder unit 51. Given these conditions, the user can remove the entire toner cartridge 20 from the holder unit 51** in the direction of axis.

The toner replenishing opening 28 moves in the direction of circumference in accordance with the above rotating manipulation: it moves from inside of the rectangular opening 34 to the closing position where it opposes the circumference wall surface 30 to be covered by the same. Note that since the buffering seal material is adhered to the circumference wall surface 30, the space between the toner replenishing opening 28 and circumference wall surface 30 is filled by the same, thereby securing the airtightness of the toner replenishing opening 28.

When pulling out the toner cartridge 20 in the direction of axis under these conditions, the circumference wall surface 30 of the seal cap 22 releases the contact with the internal wall of the holder unit 51, and the pressing force is no longer applied to the press operating unit **32*a* of the stopping claw 32 from the holder unit 51. Accordingly, the stopping claw 32 rotates around the two central axis units 33 because of the restoring elasticity thereof, inserting the rotation limiting unit 32*b* of the stopping claw 32 into the engaging concavity unit of the seal cap 22. Consequently, the seal cap 22 can not rotate in any direction as explained above, and thus the airtightness of the toner replenishing opening 28** is maintained.

Since the internal surface of the holder unit 51 and the circumference wall surface 30 of the seal cap 22 are tapered, the above state is achieved at an early stage when the circumference wall surface 30 of the seal cap 22 releases the contact with the internal wall of the holder unit 51 slightly, in other words, when the toner cartridge 20 is pulled out in the direction of axis. Since the toner replenishing opening 28 is tightly closed in this way when the toner cartridge 20 is removed from the holder unit 51 even slightly, it is ensured that the residual toner in the container 21 will not be scattered over the copying machine main body 1 through the toner replenishing opening 28 when removing the toner cartridge 20.

When the consumed toner cartridge 20 is removed as explained above, a new toner cartridge 20 is attached to the toner supplying unit 13 in the same manner as explained above, completing the replacing manipulation.

As has been explained, according to this embodiment, when the toner cartridge 20 is not attached to the toner supplying unit 13, the user can not rotate the seal cap 22 unless he releases the engagement of the rotation limiting unit **32*b* by pressing the press operating unit 32*a* of the stopping claw 32, so that the airtightness of the toner replenishing opening 28 can be maintained. As a result, it is ensured that no toner will be scattered or no undesirable materials will enter in the toner cartridge 20** erroneously.

Also, when attaching the toner cartridge 20 to the toner supplying unit 13, the toner supplying opening 28 will not close until the engaging protrusion 26 has a contact with the second limiting side **31*b* of the rotating range limiting opening 31 by the rotation of the container 21. Thus, the user will not re-close the toner replenishing opening 28 erroneously by rotating the container 21** more than necessary, upgrading the manipulation efficiency.

On the other hand, according to this embodiment, the rib **33*a* extending inwards in the direction of diameter is formed on the two central axis units 33, around which the stopping claw 32 rotates, to secure a predetermined space around the outer circumference surface of the capped unit 25 of the container 21. Thus, even the pressing force is applied unevenly to the press operating unit 32*a* of the stopping claw 32 by the internal surface of the holder unit 51 when inserting the seal cap 22 into the holder unit 51, the rotation limiting unit 32*b* of the stopping claw 32 releases the engagement with the engaging concavity unit 27** without fail.

Further, since the chamfered surface **32*c* is formed at the corner of the press operating unit 32*a* of the stopping claw 32, the press operating unit 32*a* will not be hooked by the end of the holder unit 51 when inserting the seal cap 22 into the holder unit 51, thereby enabling the smooth insertion of the seal cap 22**.

In addition, since the internal surface of the holder unit 51 and the circumference wall surface 30 of the seal cap 22 are tapered, these two components do not demand accurate finishing. Thus, not only the processing but also the attachment/detachment manipulation can be facilitated while the toner leakage through the space between the holder unit 51 and seal cap 22 is perfectly prevented.

As has been explained, with the toner cartridge of the present invention, the engaging protrusion is formed on the outer circumference surface of the seal body capped unit, while the rotating range limiting opening, which engages with the engaging protrusion and limits the relative moving range of the same in the direction of circumference from the opening position to the closing position, is formed on the seal body. Further, the engaging concavity unit is formed on the seal body capped unit, while the rotation limiting unit which limits the rotation of the seal body by engaging with the engaging concavity unit when the seal body is positioned at the closing position and the press operating unit extending outwards from the outer surface of the seal body are formed on the seal body. Also, the rotation limiting unit is structured to have a communication with the press operating unit, so that it is released from the engaging concavity unit when the press operating unit is pressed by an external force.

According to the above structure, when the toner cartridge is not attached to the toner supplying unit in the main body such as a copying machine, the user can not rotate the seal body to the opening position unless he presses the press operating unit. Thus, unless the user does so intentionally, the seal body is maintained at the closing position without fail, minimizing the erroneous toner leakage or scattering.

Further, pressing on the press operating unit caused by the inserting manipulation, such as the close contact between the internal surface of the hold unit of the toner supplying unit in the main body and the outer surface of the seal body, automatically releases the engagement between the rotation limiting unit and the engaging concavity unit, and upgrades the manipulation and job efficiency. Also, since the position of the engaging protrusion of the seal body capped unit is limited in the rotating range limiting opening only when the engaging protrusion reaches the opening position, the container will not be rotated more than necessary when attaching the toner cartridge to the toner supplying unit, thereby enhancing the manipulation efficiency.

With another toner cartridge of the present invention, the plate member, which extends through the opening on the wall surface of the seal member and is tilted with respect to the same, is formed. The plate member communicates with the wall surface of the seal body by means of the central axis unit having the torsional elasticity at the center thereof to rotate from the tilting position to the position where it becomes parallel to the wall surface. Also, the inward portion of the plate member in the direction of diameter from the wall surface of the seal body serves as the rotation limiting unit, while the outward portion of the same serves as the press operating unit.

Thus, a functional member that serves as both the rotation limiting unit and press operating unit can be composed of the central axis unit having the torsional elasticity and a single plate member, which makes the entire structure simpler.

With another toner cartridges of the present invention, the outer surface of the seal body capped on the cross-sectional seal body capped unit is tapered, so that the diameter thereof becomes smaller on the top end side than the other side.

According to this structure, by providing the holder unit having a tapered concavity unit that matches with the outer surface of the seal body in the toner supplying unit, the seal body is easily inserted into the holder unit even when the press operating unit extends outwards from the outer surface of the seal body, upgrading the manipulation efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge comprising:

a cylindrical container for withholding toner inside thereof;

a seal body capped unit of a circular cross-sectional shape formed at one end of said container, said seal body capped unit having a toner replenishing opening;

a seal body for capping an outer circumference surface of said seal body capped unit, said seal body being rotatable between a closing position where said seal body seals said toner replenishing opening and an opening position where said seal body opens said toner replenishing opening;

an engaging protrusion formed on the outer circumference surface of said seal body capped unit;

a moving range limiting unit, formed on said seal body into which said engaging protrusion fits, for limiting a relative moving range of said engaging protrusion from the closing position to the opening position;

an engaging concavity unit formed on said seal body capped unit;

a press operating unit formed on said seal body, said press operating unit extending outwards from an outer surface of said seal body; and a rotation limiting unit, having a communication with said press operating unit, so that said rotation limiting unit releases an engagement with said engaging concavity unit when an external pressure is applied to said press operating unit, for limiting a rotation of said seal body by engaging with said engaging concavity when said seal body is at the closing position.

2. The toner cartridge of claim 1, wherein:

said rotation limiting unit and said press operating unit are made of a plate member extending through an opening formed on a wall surface of said seal body and being tilted with respect to said wall surface;

said plate member has a communication with the wall surface of said seal body through a central axis unit having torsional elasticity at a center thereof so as to rotate from the tilting position to a position where said plate member becomes parallel to the wall surface; and an inward portion of said plate member from the wall surface of said seal body in a direction of diameter is said rotation limiting unit, while an outward portion of said plate member from the wall surface of said seal body in the direction of diameter is said press operating unit.

3. The toner cartridge of claim 1, wherein the outer surface of said seal body is tapered to make a diameter of a top end thereof smaller than a diameter of a bottom end thereof.

4. The toner cartridge of claim 1, wherein:

said engaging protrusion includes a plane first stopping surface and a plane second stopping surface at both ends of said seal body capped unit in a direction of circumference, respectively, said first and second stopping surfaces being perpendicular to the outer circumference surface of said seal body capped unit; and said moving range limiting unit is an opening whose both ends in the direction of circumference are a first limiting side and a second limiting side, respectively, whereby the closing position is limited when said first stopping surface has a contact with said first limiting side, while the opening position is limited when said second stopping surface has a contact with said second limiting side.

5. The toner cartridge of claim 2, wherein said engaging concavity unit is formed by flattening a part of the outer circumference surface of said seal body capped unit, said engaging concavity having a third stopping surface perpendicular to said outer circumference surface at one end thereof in the direction of circumference, whereby said rotation limiting unit is stopped by said third stopping surface and released therefrom only when said press operating unit is pressed.

6. The toner cartridge of claim 1, wherein:

said engaging protrusion includes a plane first stopping surface and a plane second stopping surface at both ends of said seal body capped unit in a direction of circumference, respectively, said first and second stopping surfaces being perpendicular to the outer circumference surface of said seal body capped unit;

said moving range limiting unit is an opening whose both ends in the direction of circumference are a first limiting side and a second limiting side, respectively; and said engaging concavity unit is formed by flattening a part of the outer circumference surface of said seal body capped unit, said engaging concavity having a third stopping surface perpendicular to said outer circumference surface at one end thereof in the direction of circumference, whereby said rotation limiting unit is stopped by said third stopping surface when said first stopping surface has a contact with said first limiting side.

7. The toner cartridge of claim 4, wherein:

said moving range limiting unit further includes an assembling cutout opening by which said seal body caps on said seal body capped unit; and said seal body includes a rectangular opening opposing said moving range limiting unit through which the toner is supplied into the toner replenishing opening of said container.

8. The toner cartridge of claim 2, wherein said central axis unit is a protrusion extending inwards from an internal surface of a circumference wall surface of said seal body to secure a space between said seal body capped unit and an internal circumference surface of said seal body, said space being as thick as said protrusion.

9. The toner cartridge of claim 2, wherein the outer surface of said seal body is tapered to make a diameter of a top end thereof smaller than a diameter of a bottom end thereof.

10. The toner cartridge of claim 9 further comprising a holder for holding said seal body, wherein:

said plate member has a chamfered unit made by cutting out a corner of a top end side of said press operating unit diagonally; and said holder has a slope surface at a corner of an internal circumference of an end surface on an opening side thereof, said slope surface matching with said chamfered unit of said plate member.

11. The toner cartridge of claim 7 further comprising a holder for supporting said seal body, wherein said holder includes a toner outlet, and around which a seal cushion in a shape such that matches with said rectangular opening is adhered on an internal surface of said holder, said seal cushion filling a space between the internal surface of said holder and the outer circumference surface of said seal body capped unit around said toner replenishing opening.

* * * * *